US006882324B1

(12) United States Patent
Chen

(10) Patent No.: US 6,882,324 B1
(45) Date of Patent: Apr. 19, 2005

(54) DOUBLE FREQUENCY ANTENNA

(75) Inventor: Po-Chao Chen, Taipei (TW)

(73) Assignee: SmartAnt Telecom Co., Ltd., Hsinchu (TW)

( * ) Notice: Subject to any disclaimer, the term of this patent is extended or adjusted under 35 U.S.C. 154(b) by 42 days.

(21) Appl. No.: 10/670,606

(22) Filed: Sep. 26, 2003

(51) Int. Cl.[7] ..... H01Q 9/04
(52) U.S. Cl. ..... 343/790; 343/792; 343/795; 343/727
(58) Field of Search ..... 343/790, 792, 343/795, 727, 791, 793, 725, 726, 702, 729, 730; H01Q 9/04

(56) References Cited

U.S. PATENT DOCUMENTS 6,222,494 B1 * 4/2001 Erkocevic ..... 343/790
2002/0024474 A1 * 2/2002 Chen ..... 343/792
2002/0190912 A1 * 12/2002 Lebaric et al. ..... 343/795
2004/0056805 A1 * 3/2004 Chen ..... 343/700 MS
2004/0183727 A1 * 9/2004 Choi ..... 343/700 MS

* cited by examiner

*Primary Examiner*—Hoanganh Le
(74) *Attorney, Agent, or Firm*—Birch, Stewart, Kolasch & Birch, LLP

(57) ABSTRACT

A double frequency antenna for transmitting and receiving radio signals includes a first substrate and a second substrate. The first substrate has a first surface and a second surface opposing each other. The first surface has a first radiation section to radiate a corresponding first frequency. The second surface has a first ground section. The second substrate has four L-shape corners, and a first surface and a second surface opposing each other. The first surface has a second radiation section to radiate a corresponding second frequency. The second surface has a second ground section.

7 Claims, 4 Drawing Sheets

DOUBLE FREQUENCY ANTENNA

FIELD OF THE INVENTION

The invention relates to an antenna and particularly to a double frequency antenna adopting the IEEE 802.11 standard of wireless local area networks.

BACKGROUND OF THE INVENTION

The wireless local area network (WLAN) is a mobile network surfing technique that has the features of high mobility to free from the constraint of the wired network and easy installation. Hence these days, the WLAN can not only meet network requirements in houses, it is also increasingly popular in public locations such as airports, restaurants, cafes and the like to provide network surfing services for users whenever needed.

In order to enable the technique of WLAN to be widely adopted, industry standards or protocols must be established to ensure that equipment produced by all vendors is compatible and has the required reliability. Those standards have been established by The Institute of Electrical and Electronic Engineers (IEEE). The earliest specification is IEEE 802.11, announced in 1997. Then IEEE 802.11a and IEEE 802.11b were announced in September 1999.

The earlier specification defines applications for a radio frequency spectrum 2.4 GHz, and provides transmission speed specifications for 1 Mbps and 2 Mbps and many basic signal transmission methods and services. Nowadays, IEEE 802.11a and IEEE 802.11b have gradually become the main-stream standards, using respectively two frequency spectrums of 5.8 GHz and 2.4 GHz.

IEEE 802.11a and IEEE 802.11b are two incompatible frequency spectrums. Some vendors have endeavored in technical developments for both spectrums. In addition, the U.S.A, Europe and Japan do not permit 5 GHz to be used outdoors in order to prevent interference with satellite bound mobile phones and weather radars. Every country has restrictions on emission power of high frequency communication devices. This is especially true for the 5 GHz frequency spectrum. Depending on different regulations of various countries, allocation of this spectrum also is different. In such circumstances, it is necessary to enable 2.4 GHz to coexist with 5 GHz.

With the 2.4 GHz frequency spectrum and the 5 GHz frequency spectrum coexist on the same communication chip, the antenna must also be able to simultaneously receive the frequencies of these two frequency spectrums. Thus double frequency antenna has become a mandatory element for WLAN implementation.

SUMMARY OF THE INVENTION

In view of the aforesaid problems, the primary object of the invention is to provide a double frequency antenna to receive frequencies in two different frequency spectrums.

In order to achieve the foregoing object, the double frequency antenna of the invention includes a first substrate and a second substrate. The first substrate has a first surface and a second surface opposing each other. The first surface has a first radiation section to radiate a corresponding first frequency. The second surface has a first ground section. The second substrate has four corners formed in an L-shape, and includes a first surface and a second surface opposing each other. The first surface has a second radiation section to radiate a corresponding second frequency. The second surface has a second ground section.

The foregoing, as well as additional objects, features and advantages of the invention will be more readily apparent from the following detailed description, which proceeds with reference to the accompanying drawings.

DESCRIPTION OF THE PREFERRED EMBODIMENTS

In general, the parameters required for designing an antenna, depending on the application scope, include frequency range, radiation half-power beamwidth (HPBW) on the emission vertical plane (E-plane) and horizontal plane (H-plane), voltage standing wave ratio (VSWR), and antenna gain. By altering the values of these parameters, an antenna may be designed to meet various requirements.

Figure 1A:
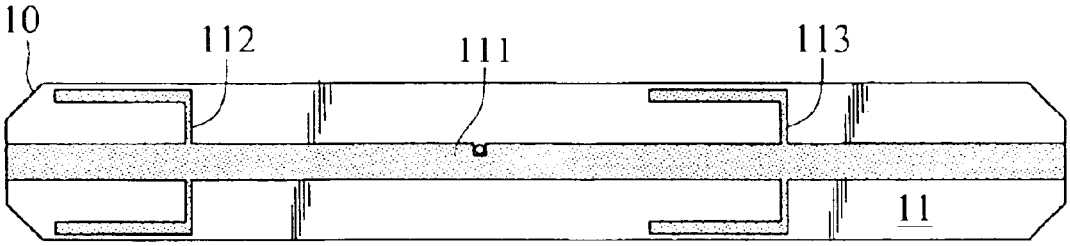
FIG. 1A is a schematic view of a radiation section of the first surface of an antenna structure adopted for the IEEE 802.11a frequency spectrum.
Figure 1B:
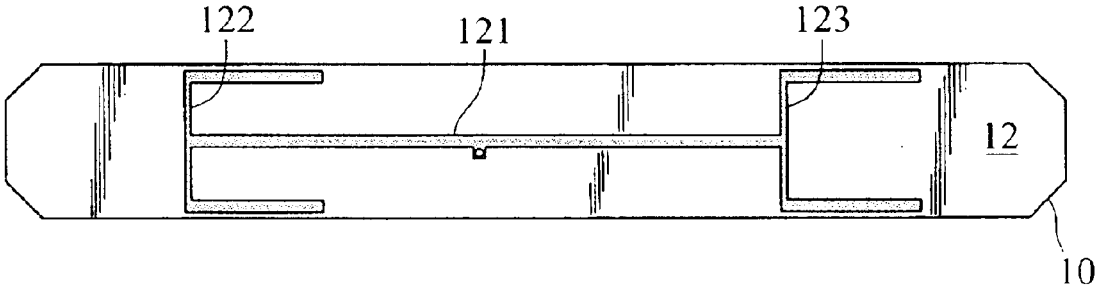
FIG. 1B is a schematic view of a ground section of the second surface of an antenna structure adopted for the IEEE 802.11a frequency spectrum.

Refer to FIGS. 1A and 1B for the antenna structure adopted for the IEEE 802.11 a frequency spectrum. The antenna is a flat print antenna. It includes a first substrate 10 made from glass fibers or other like materials. The first substrate 10 has a first surface 11 and a second surface 12 opposing each other. The first surface 11 has a first radiation section which consists of an elongate first radiation area 111, a second radiation area 112 and a third radiation area 113. The first radiation area 111 is located in the center of the first area 11 and has a length substantially the same as the first substrate 10. The second radiation area 112 and the third radiation area 113 are two normal L-type areas located on two sides opposite the first radiation area 111. The second radiation area 112 and the third radiation area 113 have the same shape and size, and have an opening in the same direction. The first radiation area 111, second radiation area 112 and third radiation area 113 form a radiation zone to receive and radiate frequencies corresponding to the frequency spectrum of 802.11a.

Refer to FIG. 1B for the construction of the second surface 12. It has a ground section, which consists of an elongated first ground area 121, a second ground area 122 and a third ground area 123. The second ground area 122 and the third ground area 123 are two normal L-type areas located on two sides opposite the first ground area 121. The first ground area 121 is located in the center of the second ground area 122 and has a width smaller than the first radiation area 111. The second ground area 122 and the second radiation area 112 are laid to form a mirror relationship. The third ground area 123 and the third radiation area 113 also are laid to form a mirror relationship. The second ground area 122 and the third ground area 123 are two normal L-type areas located on two sides opposite the first ground area 121. The first ground area 121 has two distal ends located between the L-type bottoms of the second ground area 122 and the third ground area 123, i.e., the first ground area 121 is located between the second ground area 122 and the third ground area 123.

Figure 2A:
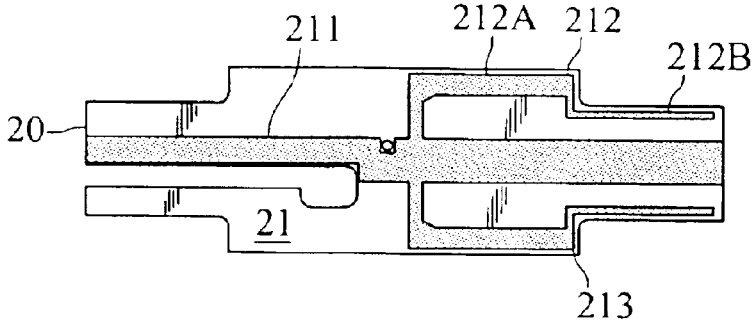
FIG. 2A is a schematic view of a radiation section of the first surface of an antenna structure adopted for the IEEE 802.11b frequency spectrum.
Figure 2B:
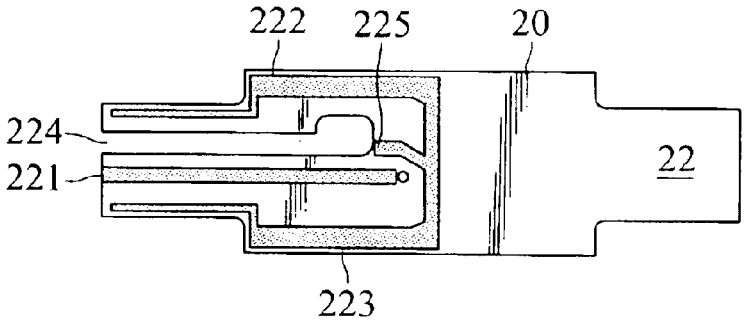
FIG. 2B is a schematic view of a ground section of the second surface of an antenna structure adopted for the IEEE 802.11b frequency spectrum.

Refer to FIGS. 2A and 2B for the antenna structure adopted for use in the IEEE 802.11b frequency spectrum. The antenna of the invention is a flat print antenna, and includes a second substrate 20 made from glass fibers or other like materials. The second substrate 20 has a first surface 21 and a second surface 22 opposing each other, and four L-shape corners.

The first surface 21 of the second substrate 20 has a second radiation section which consists of an elongate first radiation area 211, a second radiation area 212 and a third radiation area 213. The first radiation area 211 of the second radiation section is located in the center of the first radiation area 21 of the second substrate 20. The second radiation area 212 is formed in a zigzag section, which includes a first L-shape area 212A connecting to a second L-shape area 212B. The second L-shaped area 212B has a smaller width than the first L-shape area 212A, and matches the corner shape of the second substrate 20. The third radiation area 213 and the second radiation area 212 are laid to form a mirror relationship and are located on an opposing side of the first radiation area 211. The first radiation area 211, second radiation area 212 and third radiation area 213 form a radiation zone to receive and radiate frequencies corresponding to the frequency spectrum of 802.11b.

Refer to FIG. 2B for the construction of the second surface 22. It has a second ground section which consists of a first ground area 221, a second ground area 222 and a third ground area 223. The second ground area 222 and the third ground area 223 form an a mirror relationship with the second radiation area 212 and the third radiation area 213. The first ground area 221 is not in contact with the second ground area 222 and the third ground area 223, but is spaced from them at a selected distance, and has an opening 224 on one side close to the first ground area 221. When the second substrate 20 is stacked onto the first substrate 10, the first surface 21 of the second substrate 20 is in contact with the first surface 11 of the first substrate 10, and a portion of the first radiation area 11 of the first substrate 10 is exposed, while the non-exposed portion is in contact with the first radiation area 21 of the second substrate 20. In addition, the juncture of the second ground area 222 and the third ground area 223 forms a protrusive member 225.

Figure 3:
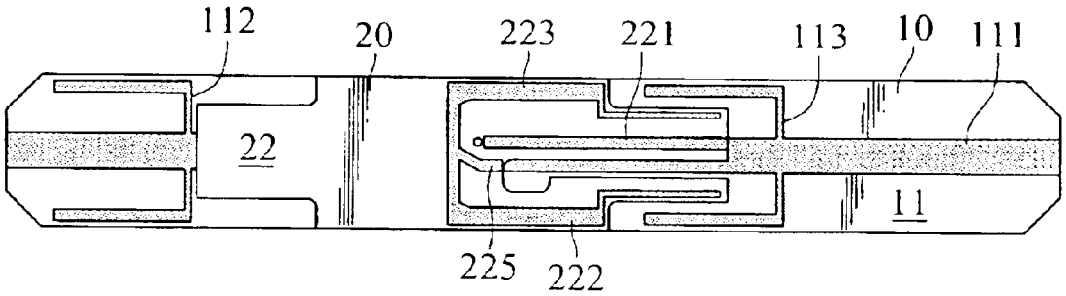
FIG. 3 is a schematic view of a double frequency antenna assembly of the invention.

Refer to FIG. 3 for the double frequency antenna of the invention. There is a blank area between the second radiation area 112 and the third radiation area 113 of the first surface 11 of the first substrate 10 to form a second antenna to achieve the double frequency object. As shown in the drawing, the second substrate 20 has four L-shape corners. When the first substrate 10 is bonded to the second substrate 20, the L-shape areas of the second ground area 222 and the third ground area 223 of the second surface 22 of the second substrate 20 are located in the third radiation area 113 of the first surface 11 of the first substrate 10.

Figure 4A:
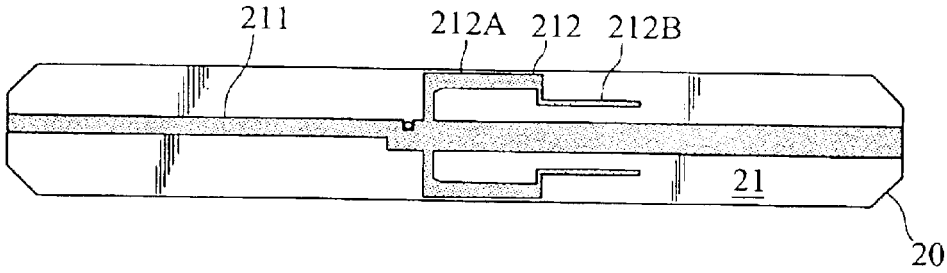
FIG. 4A is a schematic view of a radiation section of the first surface of an antenna structure adopted for the IEEE 802.11b frequency spectrum according to a second embodiment of the invention.
Figure 4B:
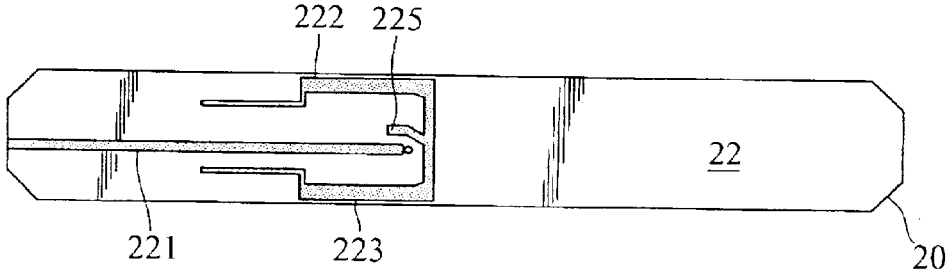
FIG. 4B is a schematic view of a ground section of the second surface of an antenna structure adopted for the IEEE 802.11b frequency spectrum according to a second embodiment of the invention.
Figure 5:
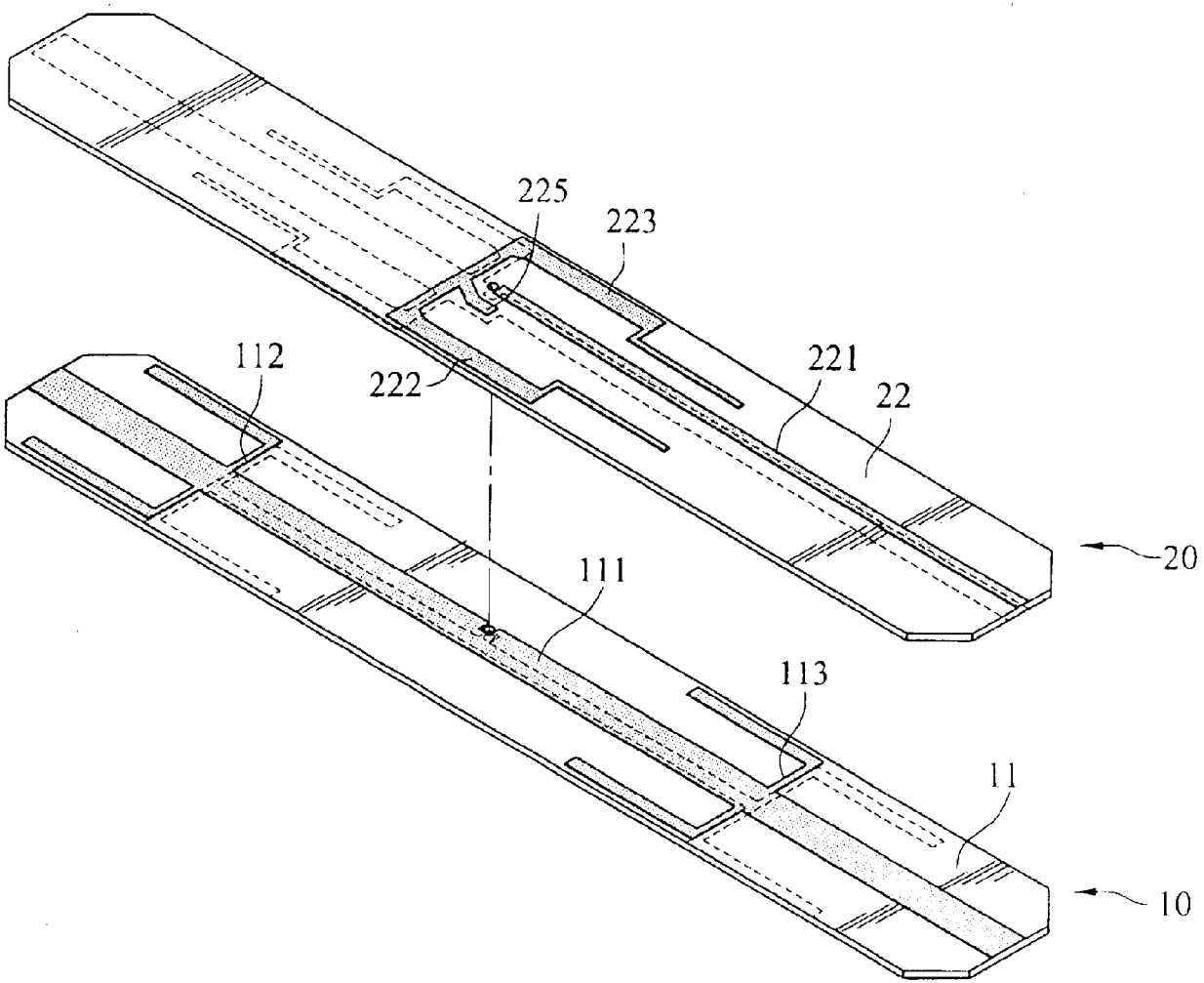
FIG. 5 is a schematic view of a double frequency antenna assembly of the second embodiment of the invention.

In order to facilitate fabrication and assembly, a second embodiment is proposed as shown in FIGS. 4A and 4B. FIG. 4A is for the radiation section of the first surface of a second embodiment of the antenna structure adopted for use in the IEEE 802.11b frequency spectrum. FIG. 4B is for the radiation section of the first surface of a second embodiment of the antenna structure adopted for use in the IEEE 802.11b frequency spectrum. The difference between the first and the second embodiment is that the length of the second substrate in the second embodiment matches the first substrate. Hence after printing of the antenna is finished, the first substrate and the second substrate may be aligned and directly compressed or bonded together. This is more convenient and the antenna matching problem does not need to be considered. The assembled product is shown in FIG. 5.

The double frequency antenna of the invention is applicable simultaneously to the standards of IEEE 802.11 a and 802.11b, and enables a radio module to receive the frequencies of two different frequency spectrums according to actual requirements.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A double frequency antenna, comprising:

a first substrate having a first surface and a second surface opposing each other, the first surface having a first radiation section to radiate a corresponding first frequency, the second surface having a first ground section; and a second substrate having four L-shape corners, and a first surface and a second surface opposing each other, the first surface having a second radiation section to radiate a corresponding second frequency, the second surface having a second ground section;

wherein the second radiation section of the second substrate has an opening in the center thereof so that the first surface of the second substrate and the first surface of the first substrate are in contact with each other when the second substrate is stacked onto the first substrate, a portion of the first radiation area of the first substrate being exposed, and the non-exposed portion being in contact with the second radiation section of the second substrate.

2. The double frequency antenna of claim 1, wherein the first radiation section of the first substrate comprises:

an elongate first radiation area located in the center of the first surface of the first substrate having a length substantially same as that of the first substrate;

a second radiation area consisting of two normal L-shape areas located on two sides opposite to the first radiation area; and a third radiation area consisting of two normal L-shape areas located on two sides opposite to the first radiation area.

3. The double frequency antenna of claim 1, wherein the first ground section of the first substrate comprises:

an elongate first ground area located in the center of the second surface having a width smaller than that of the first radiation area;

a second ground area consisting of two normal L-shape areas located on two sides opposite to the first ground area and being formed a mirror relationship with the second radiation area; and a third ground area consisting of two normal L-shape areas located on two sides opposite to the first ground area and being formed a mirror relationship with the third ground area;

wherein the first ground area is located between L-shape bottoms of the second ground area and the third ground area.

4. The double frequency antenna of claim 1, wherein the second radiation section of the second substrate comprises:

an elongate first radiation area located in the center of the first surface of the second substrate;

a second radiation area having a zigzag section which consists of a first L-shape area connecting to a second L-shape area, the second L-shape area having a width smaller than that of the first L-shape area and mating a corner shape of the second substrate; and a third radiation area located on an opposite side of the first radiation area forming a mirror relationship with the second radiation area.

5. The double frequency antenna of claim 1, wherein the second ground section of the second substrate comprises:

an elongate first ground area located in the center of the second surface of the second substrate;

a second ground area formed a mirror relationship with the second radiation area of the first surface of the second substrate; and a third ground area formed an a mirror relationship with the third radiation area of the first surface of the second substrate;

wherein the first ground area is spaced from the second ground area and the third ground area, and has an opening on one side thereof abutting the first ground surface.

6. The double frequency antenna of claim 1, wherein the first frequency is 5.8 GHz.

7. The double frequency antenna of claim 1, wherein the second frequency is 2.4 GHz.

* * * * *